US005235310A

United States Patent [19]

Cowman et al.

[11] Patent Number: 5,235,310

[45] Date of Patent: Aug. 10, 1993

[54] VARISTOR HAVING INTERLEAVED ELECTRODES

[75] Inventors: Stephen P. Cowman; Ramon Puyane, both of Louth, Ireland

[73] Assignee: Harris Corporation, Melbourne, Fla.

[21] Appl. No.: 543,516

[22] Filed: Jun. 26, 1990

[30] Foreign Application Priority Data

Mar. 16, 1990 [GB] United Kingdom ..... 9005990

[51] Int. Cl.[5] ..... H01C 7/10

[52] U.S. Cl. ..... 338/21; 338/314

[58] Field of Search ..... 338/20, 21, 314

[56] References Cited

U.S. PATENT DOCUMENTS 3,598,763 8/1971 Matsuoka et al. .
3,663,458 5/1972 Matsuyama et al. .
3,863,193 1/1975 Matsuura et al. .
4,045,374 8/1977 Nagasawa et al. .
4,148,135 4/1979 Sakshaug et al. .
4,730,179 3/1988 Nakata et al. ..... 338/20
4,918,421 4/1990 Lawless et al. ..... 338/21
4,959,262 9/1990 Charles et al. ..... 338/21 X

FOREIGN PATENT DOCUMENTS 1478772 7/1977 United Kingdom .

*Primary Examiner*—Marvin M. Lateef
*Attorney, Agent, or Firm*—Watov & Kipnes

[57] ABSTRACT

A multilayer varistor has interleaved layers of ceramic material and electrode material. Each electrode layer is sandwiched between two ceramic layers. The ceramic material includes zinc oxide, ceramic structure influencing additives selected from the group consisting of bismuth oxide, boron oxide, chromium oxide, cobalt oxide, manganese oxide and tin oxide, and a grain growth influencing additive selected from the group consisting of antimony oxide, silicon dioxide and titanium dioxide.

13 Claims, 3 Drawing Sheets

VARISTOR HAVING INTERLEAVED ELECTRODES

FIELD OF THE INVENTION

The field of the present invention relates to varistor compositions.

RELATED APPLICATIONS

This application is related to co-pending U.S. patent applications Ser. No. 07/543,528 filed Jun. 26, 1990; U.S. patent application Ser. No. 07/543,921 filed Jun. 26, 1990; U.S. patent application Ser. No. 07/543,932 filed Jun. 26, 1990; and U.S. patent application Ser. No. 07/543,529 filed Jun. 26, 1990. The teachings of these applications are incorporated herein by reference.

BACKGROUND OF THE INVENTION

Zinc oxide varistors are ceramic semiconductor devices based on zinc oxide. They have highly non-linear current/voltage characteristics, similar to back-to-back Zener diodes, but with much greater current and energy handling capabilities. Varistors are produced by a ceramic sintering process which gives rise to a structure consisting of conductive zinc oxide grains surrounded by electrically insulating barriers. These barriers are attributed to trap states at grain boundaries induced by additive elements such as bismuth, cobalt, praseodymium, manganese and so forth.

The electrical characteristics of a metal oxide varistor, fabricated from zinc oxide, are related to the bulk of the device. Each zinc oxide grain of the ceramic acts as if it has a semiconductor junction at the grain boundary. The non-linear electrical behavior occurs at the boundary of each semiconducting zinc oxide grain. Accordingly, the varistor can be considered as a multi-junction device, composed of many series and parallel connections of grain boundaries. The device behavior may be analyzed with respect to the details of the ceramic microstructure. Mean grain size and grain size distribution play a major role in electrical behavior.

Fabrication of zinc oxide varistors has traditionally followed standard ceramic techniques. The zinc oxide and other constituents are mixed, for example by milling in a ball mill, and are then spray dried. The mixed powder is then pressed to the desired shape, typically tablets or pellets. The resulting tablets or pellets are sintered at high temperature, typically 1,000° to 1,400° C. The sintered devices are then provided with electrodes, typically using a fired silver contact. The behavior of the device is not affected by the configuration of the electrodes or their basic composition. Leads are then attached by solder and the finished device may be encapsulated in a polymeric material to meet specified mounting and performance requirements.

In the device thus fabricated, the bulk of the varistor between its contact or electrode layers thus consists primarily of zinc oxide grains of a predetermined average grain size, yielding a specific resistivity per unit of thickness dimension. In designing a varistor for a given nominal varistor voltage, it is therefore basically a matter of selecting a device thickness such that the appropriate number of grains is in series between the electrodes. The voltage gradient of the varistor material, in terms of volts per unit of thickness dimension, can be controlled by varying the composition and manufacturing conditions of the varistor. Altering the composition of the metal oxide additives enables the grain size to be changed for this purpose. In practice, the voltage drop per grain boundary junction is approximately constant and does not vary greatly for grains of different sizes. Accordingly, varistor voltage is primarily determined by the thickness of the material and the size of the grains.

The construction and performance of varistors is discussed inter alia in "Zinc Oxide Varistors—A Review" by L. M. Levinson and H. R. Philipp, Ceramic Bulletin, Volume 65, No. 4 (1966), which article may be referred to for further detail.

A multiplicity of specific varistor compositions are known and described, inter alia, in the following patent specifications: U.S. Pat. Nos. 3,598,763; 3,663,458; 3,863,193; 4,045,374 and GB 1,478,772. Methods of manufacturing varistors are described, inter alia, in U.S. Pat. No. 3,863,193 and 4,148,135.

SUMMARY OF THE INVENTION

It is an object of the present invention to provide improved compositions of material for use in producing varistors, and improved compositions of varistors themselves. The compositions of the invention are especially suited to the provision of suspensions of zinc oxide based materials in solvents for use in producing varistors using a wet screen printing method, and it is a further object of the invention to provide improved compositions of varistor produced by printing techniques.

The present invention is especially directed to multilayer varistors and to compositions facilitating their manufacture. While it has generally been accepted that a multilayer varistor would have a number of advantages as compared with the equivalent radial product, manufacturing problems have hitherto prevented any widespread move towards multilayer varistors.

The advantages of multilayer construction as applied to varistors include compact size for equivalent electrical characteristics, as compared with a conventional radial device. Multilayer varistors may also be completely symmetrical, fully passivated and have good IV characteristics. As against this possible disadvantages include relatively high capacitance and potential reactions between the ceramic and the internal electrodes, especially the interaction of palladium and bismuth complexes.

The present invention is further especially directed to compositions for use in the manufacture of multilayer varistors using printing techniques. A method of manufacturing a multilayer varistor by a sequence of printing operations forms a subject of a co-pending patent applications by the present applicants, as indicated above. In a particular manufacturing method disclosed in the co-pending application, both the ceramic layers and the electrode patterns are successively screen printed. A particular advantage of screen printing as compared with other manufacturing technologies for multilayer systems is that the preparation of a thin sheet material as a preliminary step in the process may be obviated, by virtue of the direct laying down of the ceramic material and the electrode pattern in a succession of printing steps. The printing process therefore provides a more convenient and expeditious method of manufacturing multilayer products, and in particular varistors, than methods involving the preliminary step of fabricating sheets or panels of ceramic and electrode material for interleaving in a later production operation. However, the successful implementation of a printing manufacturing technology for multilayer varistors requires the provision of compositions suited to this production process and capable of cooperating with solvent materials to provide the required ceramic and electrode inks.

The present invention provides ceramic powder compositions suited to screen printing manufacturing technologies for multilayer varistors and for use in ink formulations forming the subject of co-pending applications by the present applicants, as indicated above.

According to the invention, there is provided a varistor comprising a plurality of layers of ceramic material and a plurality of layers of electrode material, with the respective layers being interleaved, with each electrode material layer being sandwiched between two ceramic material layers, wherein at least one of the ceramic layers comprises:

(a) zinc oxide, (b) a plurality of ceramic structure influencing additives selected from the group consisting of at least bismuth oxide, boron oxide, chromium oxide, cobalt oxide, manganese oxide and tin oxide, and (c) at least one grain growth influencing additive selected from the group consisting of at least antimony oxide, silicon dioxide and titanium dioxide.

The plurality of ceramic structure influencing additives may include at least bismuth oxide, cobalt oxide and manganese oxide. Preferably at least one of the ceramic layers may comprise at least one electrical performance influencing additive selected from the group consisting of at least aluminum oxide and silver oxide. The same ceramic layer may further comprise magnesium oxide as an additional additive.

In a second aspect, the invention provides a voltage variable resistor ceramic composition comprising:

(a) 94 to 98 mole percent of zinc oxide, (b) 1 to 4 mole percent of a plurality of ceramic structure influencing additives selected from the group consisting of at least bismuth oxide, boron oxide, chromium oxide, cobalt oxide, manganese oxide and tin oxide, and (c) 0.1 to 1.6 mole percent of at least one grain growth influencing additive selected from the group consisting of at least antimony oxide, silicon dioxide and titanium dioxide.

The composition suitably comprises 0.002 to 0.01 mole percent of at least one electrical performance influencing additive selected from the group consisting of at least aluminum oxide and silver oxide. The composition may further comprise 0.6 to 1.1 mole percent of nickel oxide as a further additive and at least 0.4 mole percent of manganese oxide as an additional additive.

In yet another aspect, there is provided according to the invention a composition material for use in manufacturing a varistor comprising:

(a) 94 to 98 mole percent of zinc oxide, (b) 1 to 4 mole percent of a plurality of ceramic structure (b) 1 to 4 mole influencing additives selected from the group consisting of at least bismuth oxide, boric acid, chromium oxide, cobalt oxide, manganese oxide and tin oxide, and (c) 0.1 to 1.6 mole percent of at least one grain influencing additive selected from the group consisting of at least antimony oxide, silicon dioxide and titanium dioxide.

The material may comprise 0.002 to 0.01 mole percent of at least one electrical performance influencing additive selected from the group consisting of at least aluminum oxide and silver oxide. The material may further comprise 0.6 to 1.1 mole percent of nickel oxide as a further additive, and at least 0.4 mole percent of magnesium hydroxide as an additional additive.

In an especially favored embodiment of said material, the constituent materials are in granular or powder form and the average grain size of the granular or powder form material is less than approximately 2 microns.

Also, the composition of the material used in manufacturing a varistor may comprise:

(a) an organic solvent carrier, (b) an organic viscosity-influencing additive, and (c) an organic binder.

The relative proportions of the organic constituents may be selected so that the mixture of the organic and inorganic constituents of the composition material is in the form of a suspension.

The composition material may be prepared by:

(i) calcining a granular or powder form composition material according to the invention, and (ii) mixing the calcined composition material with an organic solvent carrier, an organic viscosity-influencing additive, and an organic binder.

Preferably, the additive is added for a first stage of the mixing step, and the binder is added following the first stage of the mixing step, the binder being mixed with the other constituents of the material in a second stage of the mixing step. The first stage of the mixing step may comprise a milling operation.

BRIEF DESCRIPTION OF THE DRAWINGS

The present invention will be described in detail below relative to the associated drawings, in which like items are identified by the same reference designation, wherein.

DETAILED DESCRIPTION OF THE INVENTION

Figure 1:
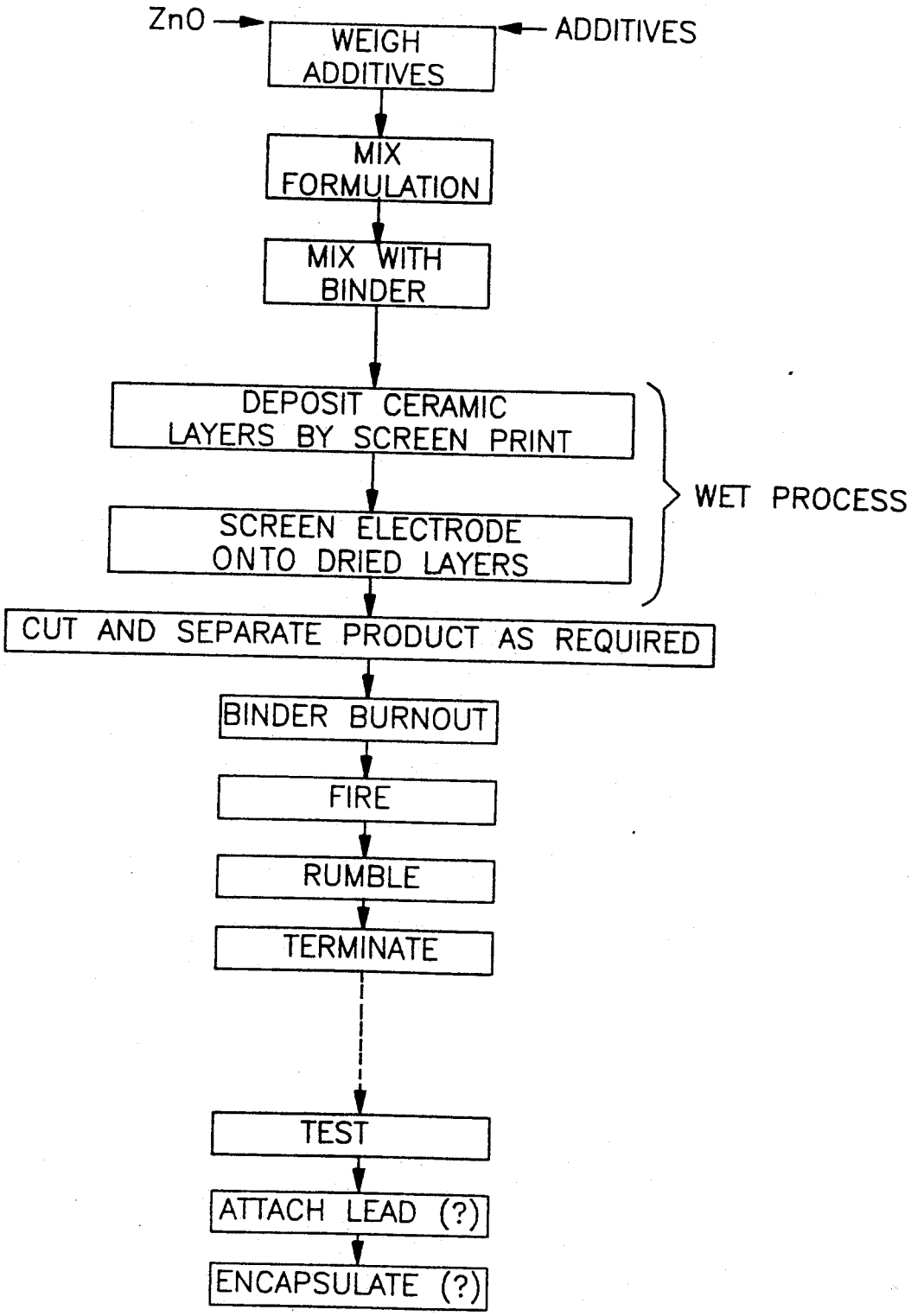
FIG. 1 is a block diagram showing a sequence of process steps for the manufacture of a multilayer varistor.

As shown in FIG. 1, zinc oxide powder and additives are weighed preparatory to mixing to provide a powder formulation suitable for manufacturing the particular varistor desired. The powder formulation is then mixed with suitable organic constituents to provide a ceramic ink. A cycle of operations then takes place, in which, following the preparation of suitable screens, ceramic layers are deposited onto a substrate by screen printing and are interleaved with electrode layers similarly screen printed onto semi-dried layers of ceramic material.

Following completion of the printing operations, the printed layered product supported on the substrate is separated to provide a multiplicity of multilayer varistor units. Subsequent treatment steps are broadly conventional, in that the binder and other organics are burnt out. The product is then fired and rumbled, terminations are applied for electrical communication between the varistor and other circuit elements, and the finished varistor is then tested. Optional final steps include the attachment of leads and overall encapsulation.

Co-pending patent applications by the present applicants entitled "Varistor Structures", (Attorney Docket No. 28 EC 0004), "Varistor Configurations" (Attorney Docket No. 28 EC 0005), and "Varistor Manufacturing Method and Apparatus" (Attorney Docket No. 28 EC 0006) disclose details of multilayer varistor constructions derived from a screen printing manufacturing process together with a novel manufacturing method for multilayer varistors, which teachings are incorporated herein by reference. The present invention provides novel compositions of powders suitable for use in this method and in the production of multilayer varistors.

Figure 3:
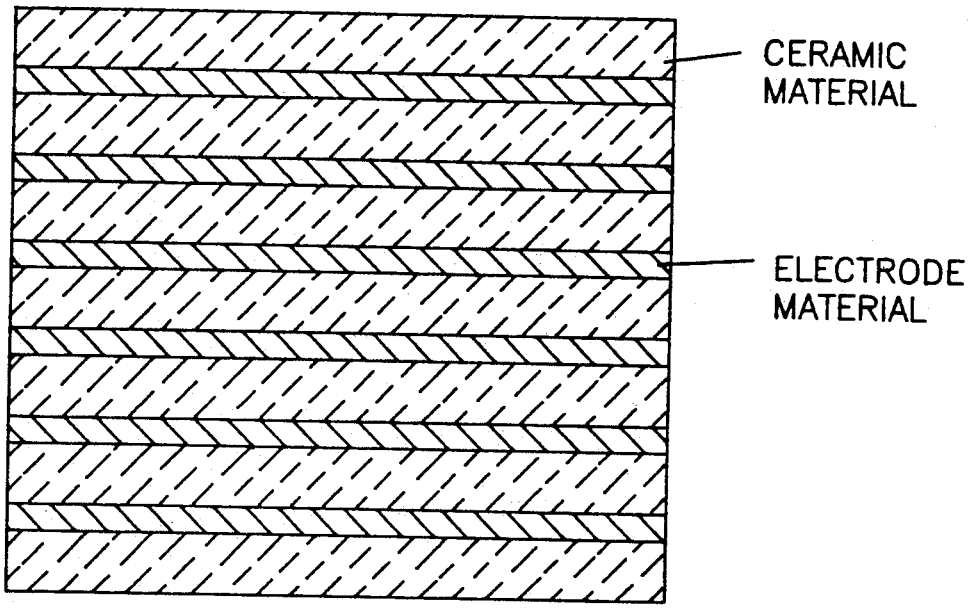
FIG. 3 is a block diagram of a multi-layer varistor according to the invention.

FIG. 3 shows a multi-layer varistor in which the electrode material is sandwiched between the ceramic material and the respective layers are interleaved.

Table 1, following, lists materials present in powder formulations for varistors, and in particular in ceramic powder compositions for use in the manufacture of multilayer varistors:

TABLE 1

| Material | Formula |
|---|---|
| Zinc Oxide | Zn |
| Bismuth Oxide | $Bi_2O_3$ |
| Cobalt Oxide | $Co_2O_3$ |
| Manganese Oxide | $MnO_2$ |
| Nickel Oxide | NiO |
| Antimony Oxide | $Sb_2O_3$ |
| Silicon Dioxide | $SiO_2$ |
| Magnesium Hydroxide | $Mg(OH)_2 \rightarrow MgO$ |
| Aluminum Nitrate | $Al_2O_3$ added as $Al_2(NO_3)_3 \cdot 9H_2O$ |
| Chromium Oxide | $Cr_2O_3$ |
| Barium Carbonate | $BaCO_3 \rightarrow BaO$ |
| Boric Acid | $HBO_3$ |
| Titanium Dioxide | $TiO_2$ |
| Tin Oxide | $SnO_2$ |
| Silver Oxide | $Ag_2O$ |

These various materials as listed in Table 1 may be grouped as follows:

1. Zinc Oxide

Zinc oxide forms 92.0 mole-percent of the bulk, typically in the range of 85.0 to 95.0 mole-percent of the bulk of a varistor formulation, for example. For low voltage varistors, barium grains may be added, in the form of barium carbonate, and transformed to barium oxide during the manufacturing process. The function of the barium is is to promote the growth of zinc oxide grains, whereby this additive disappears after sintering of the varistor.

2. Glass-Related materials (ceramic structure influencinq additives)

These additives serve to enhance the development of the ceramic structure. They include the following materials listed in Table 1:

Bismuth oxide, added in the trioxide form. This is a glass-forming additive.

Cobalt oxide is another glass additive agent, assisting the glass frit and serving to maintain phase stability in the ceramic.

Manganese oxide has an augment effect similar to that of bismuth oxide.

Chromium oxide is a further glass additive functioning to stabilize the ceramic product. Boric acid is another glass former.

Tin oxide is yet another stabilizer for the glass structure, albeit less commonly used than those already cited.

3. Grain Growth Modifiers (grain growth influencing additives)

Antimony oxide is an additive controlling grain growth. It acts as an inhibitor to keep grain size small. This is particularly important in high voltage devices.

Silicon dioxide is a strong grain growth inhibitor and is added to compositions or powder formulations to get high values of voltage per millimeter thickness. Silicon dioxide per se is however highly conductive and absorbs energy when the junctions at the depletion layer breakdown and conduct. In a varistor, the grain structure is almost entirely zinc oxide, and the additives go into the glass matrix which surrounds the grains. It is this aspect of the construction of varistors that results in the highly significant impact of small quantities of additives on the performance of the device, as exemplified by the action of the conductive silicon dioxide at the grain boundaries. The remaining grain growth enhancing additive of those listed in Table 1 is titanium dioxide, also usable in multilayer varistors.

4. Nickel Oxide

Nickel oxide is a unique additive, having properties not achieved by any of the other additive materials, and is directed to stabilization of the microstructure. The nickel oxide assists the formation of a microstructure in the ceramic material suitable for handling both DC and AC stress.

5. Junction-Related Additives (electrical performance influencing additives)

Aluminum nitrate is a crucial additive under this category. The nitrate is transformed into an oxide in the course of the manufacturing method. As in the case of the majority of other additives, it goes into the glass matrix surrounding the grains. Aluminum oxide in very small parts per million enhances the conductivity of the zinc oxide. However, for higher additive levels, the aluminum oxide diffuses into the grain boundaries and can create a leaky device by reducing intergranular activity. Conversion of the nitrate takes place during sintering. Silver oxide is used in combination with the aluminum additive in various formulations, to achieve certain desirable results in the varistor.

6. Other Additives

Magnesium hydroxide, which transforms to magnesium oxide in the finished product, comes under this category. The function and action of this additive is obscure, and the nature of its contribution to the performance of the varistor device is not completely understood. It is however a traditional additive material in radial-type varistors.

The foregoing categorization of the materials comprised in a powder formulation for a varistor product represents only one manner of viewing the purpose and function of each of the various materials and additives comprised in the product. However, the particular analysis set forth is effective in explaining certain of the performance characteristics of varistor devices, and in particular, multilayer construction of such devices. The analysis has also been found beneficial in the development and preparation of useful novel powder formulations, especially formulations particularly suited to use in ceramic inks for application in screen printing varistor production methods. It is not however claimed to be a definitive categorization or subdivision of these additives and materials, given that many aspects of varistor operation and performance remain obscure or not fully understood. The value of the present classification resides in its ability to facilitate understanding of certain aspects of varistor performance and in assisting in the development of suitable formulations, particularly for varistor products manufactured by screen printing methods.

Table 2, as given below, lists a number of powder formulations found especially suited to the preparation of ceramic inks for use in the manufacture of multilayer varistors by screen printing techniques. For each of the formulations listed, the quantity of both the basic zinc oxide and of each category of additive, as identified above, is quoted in mole-percent. Desirable physical features of the powder formulations listed will be subsequently identified, in discussing the preparation of ceramic inks. It will however be noted from Table 2 that the additives are present in different quantities from formulation to formulation. The precise quantities of additives selected in each category depend on the purpose and performance desired of the varistor. For example, silicon dioxide is a stronger inhibitor of grain growth than antimony oxide. However, the use of silicon in larger quantities may tend to cause a reduction in the resistance of the grain boundaries of the zinc oxide structure. In order to avoid possible problems, for example in regard to product life, which the use of silicon in large quantities might entail, alternative compositions involving a different balance of additives may therefore be substituted or favored depending on the characteristics and/or performance required of the finished device. The balance of functions and the interrelationship between the various additives is also complex and not fully understood. In order to achieve a desired performance from a finished varistor product, reformulation of, for example, the glass aspects of the composition may be required, and not necessarily variation of, for example, only a grain growth modifier, such as the silicon dioxide. The various materials and additives react and cooperate together in such a complex way that the adverse consequences of an increased level of silicon may, for example, be offset by modification of the ceramic glass structure. To an extent, therefore, the development of effective and advantageous formulations is an empirical art, guided however by theoretical considerations derived from the known characteristics of each material and additive of the composition.

TABLE 2

| Material | Formulation ID 1 mole percent | 2 mole percent | 3 mole percent | 4 mole percent | 5 mole percent |
|---|---|---|---|---|---|
| BASIC CONSTITUENT | 96.9 | 94.9 | 96.3 | 97.3 | 97.2 |
| Zinc oxide | | | | | |
| GLASS-RELATED ADDITIVE | 2.1 | 2.5 | 3.2 | 1.7 | 1.6 |
| selected from | | | | | |
| Bismuth oxide | | | | | |
| Boric Acid | | | | | |
| Chromium oxide | | | | | |
| Cobalt oxide | | | | | |
| Manganese oxide | | | | | |
| Tin oxide | | | | | |
| GRAIN-GROWTH MODIFIERS | 1.0 | 1.5 | 0.5 | 0.5 | 0.2 |
| selected from | | | | | |
| Antimony oxide | | | | | |
| Silicon oxide | | | | | |
| Titanium dioxide | | | | | |
| JUNCTION-RELATED ADDITIVES | 0.005 | 0.005 | 0.003 | 0.004 | 0.009 |
| selected from | | | | | |

TABLE 2-continued

| Material | Formulation ID 1 mole percent | 2 mole percent | 3 mole percent | 4 mole percent | 5 mole percent |
|---|---|---|---|---|---|
| Aluminum nitrate | | | | | |
| Silver oxide | | | | | |
| Nickel oxide | — | 0.7 | — | 0.5 | 1.0 |
| Magnesium hydroxide | — | 0.5 | — | — | — |

In all of the formulations shown in Table 2, the mole-percentages relate to dry product.

For use as an ink, it is required that the ceramic powder formulation be maintained in suspension in suitable solvents, and that the ink product thus formed be thixotropic, i.e. exhibit a variable viscosity depending on shear rate. A thixotropic product typically behaves like a very thick or sticky medium when the rate of application of shear force is low, but is capable of flow in the manner of a low-viscosity liquid under high rates of shear. A combination of organic materials as solvents and carriers is used to achieve this, in combination with a preferred range of particle size for the dry powder product.

Typically, the preferred grain size is approximately 1.5 microns. Varistor powder as received from the preparatory powder manufacturing stage has usually grains of considerably smaller size, for example from 0.1 to 0.2 microns. The range of grain sizes is also generally relatively wide, and the powder is not fully homogeneous. In order to render this dry powder as received suitable for incorporation in a varistor ceramic ink, the particle size must be increased and the powder homogenized. This is achieved by calcining, a step which is not normally required for most convention powders as used for radial varistors, but is however nonetheless occasionally used. The calcining step consists of firing the powder as received at between 800° C. and 920° C. and then reducing the fired powder in a milling operation.

In order to then form the thixotropic ceramic ink, organic solvents are then added to the calcined powder. These may include butyl dioxitol acetate or a terpene alcohol. The organic material acts as a carrier for the particles in suspension. Viscosity influencing materials may be added to control the rheology of the ceramic ink, in conjunction with the main solvent additive(s).

The ceramic ink, which is typically green in color, is prepared from the foregoing ingredients in the following manner:

The calcined powder is mixed together with the solvent and the viscosity modifier by ball milling or other mill methods. Suitable proportions or quantities of these constituents are quoted in Table 3 below. A further organic product is added after milling to achieve the desired ink properties and fulfill a binder function. The binder may be ethyl cellulose, ethyl hydroxy cellulose or a rosin derivative. The binder has a significant impact on the viscosity of the organic and ceramic powder mixture. For this reason, it is added to the mixture following the milling step. If the full quantity of the binder required to achieve the thixotropic qualities of the finished ink was added before milling, the viscosity of the mixture would be increased to an excessive degree, and this would impair milling performance.

In summary, considering the powder and ink preparation process as a whole, a typically 0.25 or less micron grain size powder represents the starting point. This is calcined and then ground to provide particles of 2 microns average size. Solvents in the proportions to be specified are then added to this larger particle size product and ball milling of the organic material and ceramic powder product takes place, during which the grain size is once again somewhat reduced to approximately an average figure of 1.6 microns, typically + or −10%. This level of particle size allows the powder to remain in suspension in the ink product over a relatively long period. The particle size is of considerable importance in providing a successful ceramic ink. If the particle size is too small, an undue quantity of solvent may be required, and it may also be difficult to maintain a suspension of a homogeneous nature. By contrast, if the particle size is too large, the particles will settle out under gravity, so that there is separation of the powder grains from the organic solvent materials and the binder.

Table 3 following gives the weight percentages of the powder and the organic ingredients, along with that of the zirconia cylinders, required for ball milling to give certain specified quantities of ceramic ink, also identified in the table. The limits on the organic quantities as set forth in this Table are typically + and −1%.

TABLE 3

| | | | | | | |
|---|---|---|---|---|---|---|
| Ink Volume (gal) | 3.0 | 2.5 | 2.0 | 1.5 | 1.0 | 0.5 |
| Calcined Powder (gm) | 5635 | 4695.8 | 3756.7 | 2817.5 | 1878.3 | 939 |
| Solvent (gm) | 1980 | 1650 | 1320 | 990 | 660 | 330 |
| Viscosity Modifier (gm) | 38 | 31.7 | 25.3 | 19 | 12.7 | 6.4 |
| Zirconia Cylinders (gm) | 16000 | 13300 | 10600 | 8000 | 5300 | 2700 |

The solvents, viscosity modifiers and binders used in the ceramic ink of the present invention are natural materials. They offer advantages in terms of safety, in having both low toxicity and high flash points. Alternative materials meeting the same criteria are not readily available in substitution for these preferred solvents, although alternative materials are nonetheless not excluded from the scope of the invention.

In the detailed preparation of ceramic ink in accordance with the foregoing specifications, as described and set forth in Table 3, the required quantities of the various ingredients are carefully weighed out and placed in the ball mill. The ball mill is preferably rotated at a speed of between 36 and 42 r.p.m. for a period of approximately 24 hours. The binder is added to the ceramic ink as constituted following the ball milling step during a further mixing step. The mixed product is then stored in a sealed container so that none of the volatile organic materials are lost. Following this shear mixing, adverted to above, the ink must be left in sealed storage for at least 24 hours, after which its viscosity is measured to establish its quality and suitability for printing.

Figure 2:
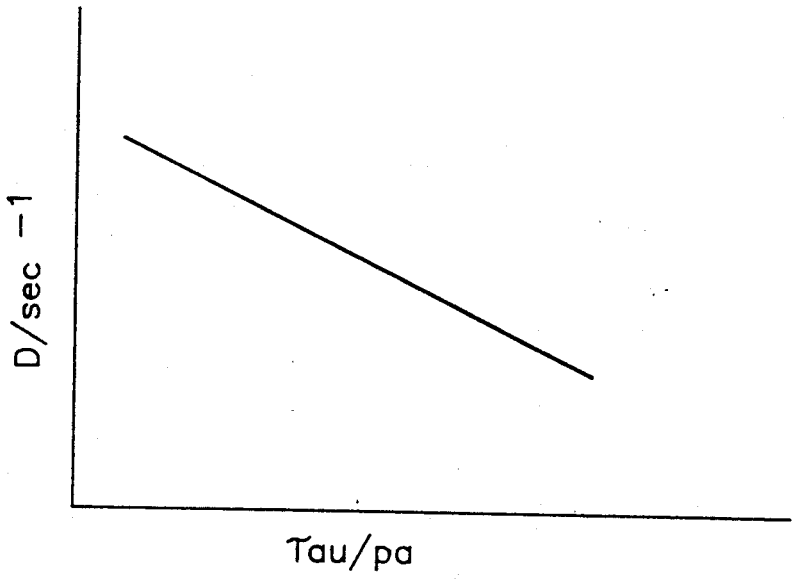
FIG. 2 is a diagram showing a plot of shear stress against shear rate for a ceramic ink according to the invention.

Viscosity is measured on any suitable viscometer such as for example a Haake viscometer. This enables a plot of shear stress against shear rate to be provided for any particular ceramic ink sample, a typical such plot is shown in FIG. 2. The plot is preferably provided with a standard "curve" or desired relationship between shear stress and shear rate, with which figures for the sample should comply within specified predetermined limits. In the event of the shear stress performance of the sample being different from that of the standard curve, the ink may be treated to adjust its viscosity. The standard curve may also allow for changes in viscosity during shelf storage of the ceramic ink prior to its use for printing purposes.

The organic materials included in the ceramic ink serve only to enable flow and laying down of the ink in the production of multilayer ceramic varistor products. During the subsequent firing of the formed products, all of the organic materials are volatilized, leaving only the ceramic powder in a sintered structure, together with the interleaved layers of electrode material.

Although various embodiments of the invention have been described herein for purposes of illustration, they are not meant to be limiting. Variations and modifications of these embodiments of the invention may occur to those of ordinary skill in the art, which modifications are meant to be covered by the spirit and scope of the appended claims.

What I claim is:

1. A varistor comprising a plurality of layers of ceramic material and a plurality of layers of electrode material, said layers being interleaved, with each electrode material layer being sandwiched between and extending across the entire length of the two ceramic material layers, wherein at least one of said ceramic layers comprises:

zinc oxide;

a plurality of ceramic structure influencing additives selected from the group consisting of at least bismuth oxide, boron oxide, chromium oxide, cobalt oxide, manganese oxide, and tin oxide; and at least one grain growth influencing additives selected from the group consisting of at least antimony oxide, silicon dioxide and titanium dioxide.

2. A varistor according to claim 1, wherein said plurality of ceramic structure influencing additives includes at least bismuth oxide, cobalt oxide and manganese oxide.

3. A varistor according to claim 1, wherein said at least one of said ceramic layers comprises at least one electrical performance influencing additive selected from the group consisting of at least aluminum oxide and silver oxide.

4. A varistor according to claim 2, wherein said at least one of said ceramic layers comprises at least one electrical performance influencing additive selected from the group consisting of at least aluminum oxide and silver oxide.

5. A varistor according to claim 1, wherein said at least one of said ceramic layers comprises nickel oxide as a further additive.

6. A varistor according to claim 2, wherein said at least one of said ceramic layers comprises at least one electrical performance influencing additive selected from the group consisting of at least aluminum oxide and silver oxide.

7. A varistor according to claim 3, wherein said at least one of said ceramic layers comprises at least one electrical performance influencing additive selected from the group consisting of at least aluminum oxide and silver oxide.

8. A varistor according to claim 4, wherein said at least one of said ceramic layers comprises at least one electrical performance influencing additive selected from the group consisting of at least aluminum oxide and silver oxide.

9. A varistor according to claim 1, wherein said at least one of said ceramic layers comprises magnesium oxide as an additional additive.

10. A varistor according to claim 2, wherein said at least one of aid ceramic layers comprises magnesium oxide as an additional additive.

11. A varistor according to claim 3, wherein said at least one of said ceramic layers comprises magnesium oxide as an additional additive.

12. A varistor according to claim 4, wherein said at least one of said ceramic layers comprises magnesium oxide as an additional additive.

13. A varistor according to claim 5, wherein said at least one of said ceramic layers comprises magnesium oxide as an additional additive.

* * * * *

UNITED STATES PATENT AND TRADEMARK OFFICE

CERTIFICATE OF CORRECTION

PATENT NO. : 5,235,310

DATED : August 10, 1993

INVENTOR(S) : Stephen Cowman et al.

It is certified that error appears in the above-indentified patent and that said Letters Patent is hereby corrected as shown below:

Column 3, line 58, delete "(b) 1 to 4 mole".

Column 5, line 1, change "Co-pending" to -- Patents and co-pending -- ;

line 2, delete "Attorney Docket";

line 3, delete "Attorney";

line 3, change "28EC0004" to --U.S. 5,115,221--;

line 4, change "Docket No. 28EC0005" to -- U.S. 5,155,464 --;

line 5, delete "Attorney Docket No. 28EC"; and line 6, change "0006" to --Serial No. 07/935,640--

Signed and Sealed this

Twenty-fourth Day of May, 1994

Bruce Lehman

BRUCE LEHMAN

*Commissioner of Patents and Trademarks*

*Attest:*

*Attesting Officer*